US005891116A

United States Patent [19]

Mast

[11] Patent Number: 5,891,116

[45] Date of Patent: Apr. 6, 1999

[54] HOT WAX SKIN TREATMENT

[75] Inventor: Rolf Mast, Riverside, Calif.

[73] Assignee: International Beauty Design, Inc., Gardena, Calif.

[21] Appl. No.: 956,814

[22] Filed: Oct. 23, 1997

Related U.S. Application Data

[60] Provisional application No. 60/029,764 Oct. 30, 1996.

[51] Int. Cl.[6] ..... A61M 35/00

[52] U.S. Cl. ..... 604/290; 604/292

[58] Field of Search ..... 604/289, 290, 604/292; 2/161.3, 161.7, 164, 167, 168

[56] References Cited

U.S. PATENT DOCUMENTS

| | | |
|---|---|---|
| 685,574 | 10/1901 | Conboie . |
| 1,264,781 | 4/1918 | Ehrhardt . |
| 1,689,680 | 10/1928 | Oppenheimer . |
| 2,141,739 | 12/1938 | Burke . |
| 2,198,989 | 4/1940 | Cooley . |
| 2,226,842 | 12/1940 | Brandt . |
| 3,298,368 | 1/1967 | Charos . |
| 4,087,675 | 5/1978 | Sansonetti . |
| 4,149,536 | 4/1979 | Villard . |

*Primary Examiner*—John G. Weiss
*Assistant Examiner*—David J. Cho
*Attorney, Agent, or Firm*—Kenneth J. Hovet

[57] ABSTRACT

A hot wax system for conditioning one's hands that includes a wax that is meltable at a temperature below that which would be harmful to one's skin. The molten wax is placed into an elastic glove that is stretchable to at least 150% of its original length and rebounds to at least 20% of its original length. Thereafter, one's hand is placed into the glove and the glove is manipulated to disperse the wax over all the hand surfaces. The hand is kept in the glove until the desired result is achieved—normally about five to thirty minutes. The process may be repeated with the user's other hand and wax dispersement can be accomplished simultaneously in both gloves by repetitively pressing the gloved hands together. The wax may be conveniently enclosed in a heat resistant container or within the glove itself to facilitate storage, heating and to insure that the correct amount of wax is being utilized.

8 Claims, No Drawings

HOT WAX SKIN TREATMENT

This application is based on Provisional Application No. 60/029,764 filed Oct. 30, 1996, now abandoned.

BACKGROUND OF THE INVENTION

1. Field of the Invention

This invention pertains to a process and an assembly for applying hot wax to one's skin.

2. Description of the Prior Art

Application of hot wax is a known moisturizing and therapeutic dermal treatment, generally used on hands and fingers. In a conventional hot wax treatment, skin is moisturized by covering the entire hand with a molten wax mixture. The wax is then allowed to solidify, where it remains on the skin for a predetermined interval of time. Traditionally, a dermal cover such as a mitten or glove is placed over the treated skin area to preserve the layer of solidified wax for the desired interval of time.

Until this invention, the wax mixture has been too costly and difficult for consumers to self-administer at home or on an individualized basis. Typically, wax must be melted in large quantities to be economically viable for dermal treatment. A safe thermostatically controlled vessel is usually required to melt the large amounts of wax. As a result, hot wax treatments have previously been feasible only at commercial salons. Moreover, conventional dermal application of wax is difficult to self-administer to both hands at one time. As a result, the process frequently requires two people.

U.S. Pat. No. 4,087,675 to Sansonetti discloses a dual layered heated mitten for use in conjunction with hand cream. Although Sansonetti provides for self-administering hot liquid hand treatments, it fails to provide a mechanism for applying molten wax mixtures. More specifically, Sansonetti uses a localized heating source to warm and release liquid hand cream. Additionally, Sansonetti is ill-suited for hot wax treatment because the mitten described therein is not elastic. As such, the mitten is inadequate for administering a viscous molten wax mixture in a continuous layer over the entire hand. Moreover, Sansonetti relies on relatively expensive electrical mittens that may not be affordable for individual personal use.

U.S. Pat. No. 3,298,368 to Charos discloses a heated gloved applicator for hand cream. As with Sansonetti, the patent fails to disclose an apparatus for applying hot wax treatments, which are more viscous than hand creams and must form a continuous coating over the hand.

SUMMARY OF THE INVENTION

The invention pertains to a process and an assembly comprising items described herein, for administering a hot wax skin treatment. More specifically, the invention provides a system for self-administering hot wax over the skin area of one's hands. The invention also provides a cost-effective means of self-administering hot wax hand treatments. The process described herein utilizes disposable elastic gloves and a predetermined quantity of wax minimized for individual use. Preferably, the wax may be enclosed within a containment means which may be used when the wax is heated and melted.

In this regard, an object of the invention is to provide an inexpensive disposable hot wax treatment system that can be conveniently packaged and sold to individual users.

Another object of the invention is to provide a simple system that allows even an inexperienced user to treat both hands with hot wax without the use of specialized equipment.

Still another object of the invention is to provide a system that requires only minimal quantities of wax to cover one's hands with a continuous layer of solidified wax.

Still another object of the invention is to provide a method for coating one's hands with molten wax, whereby the user's hands are freely mobile and functional.

A further object of the invention is to use an elastic glove to effectuate the formation of a continuous layer of solidified wax from a minimal quantity of pre-packaged wax.

Basic elements of the invention include heating a predetermined quantity of wax composition until it becomes molten. Thereafter, the wax is transferred into an elastic glove. A user's hand is then placed into the glove, causing the glove to stretch. The elastic properties of the glove facilitate effective dispersement of the wax about the contours of one's hand. After one hand has been inserted into an elastic glove, the user may immediately repeat the process with the other hand, thereby enabling both hands to be treated concurrently. After an effective period of time, the treatment is completed and the hands are withdrawn from the gloves.

The wax composition is preferably pre-packaged within a containment means, such as a plastic film, pouch or sleeve, metal foil, plastic or metal jar, bottle or can-like structure. The containment means is preferably heat resistant to permit its use during the wax heating step.

The quantity of wax is predetermined to ensure that the entire hand area can be covered by a thin continuous layer of wax, without overflow and spilling from the glove.

The melting point of the wax composition should not exceed a temperature that would be harmful to one's skin. Preferably, the wax should melt within a temperature range of 39°–55° C. The preferred wax composition comprises paraffin wax with optional additives such as fragrances, colors, emollients and anti-oxidants known in the art.

Preferably, a full-fingered elastic glove is used which is constructed of a stretchable heat resistant rubber or plastic material. The glove should have the capability of stretching to at least 150% of its original length, measured along the glove's longitudinal axis. After stretching, the glove should have sufficient elasticity to return to within at least 20% of its original length.

The elastic gloves of the invention improve over the prior art by minimizing the amount of wax necessary for the treatment. In comparison, mittens and non-elastic gloves in the prior art require 50–100% more wax to create an equivalent continuous coating of wax. Moreover, the elastic gloves require less manipulation and effort to evenly distribute the hot wax over the skin surface of the hand.

DESCRIPTION OF THE PREFERRED EMBODIMENTS

To carry out the basic steps of the invention, at least one elastic glove is provided along with a predetermined quantity of wax composition. The elastic glove of this invention should have a conventional shape comprising a hand-opening that accesses an enlarged palm area. Extending from the palm area are four separate finger sheaths and a thumb sheath. The glove may include an outer cuff to assist in preventing spillage of molten wax. Although left and right hand gloves could be provided, the invention works equally well with a universal, somewhat loose fitting, glove that adequately covers either or both hands.

The elasticity of the glove should allow it to stretch 150–200% beyond its original length, where the length is measured along its longitudinal axis. When released, the glove should return to at least about 5–20% of the original length. The glove should also be capable of containing the wax composition when it is in a molten or flowable state. Suitable full-fingered gloves available on the market include latex and rubber gloves, such as Fisher Scientific FISHER-BAND Latex Examination Gloves. Certain types of vinyl gloves might also be useful. However, they generally lack the elasticity required for the present invention.

To achieve the desired coating, there should be about 15–45 grams of wax composition per glove. For most applications, however, a range of 20–33 grams per glove is preferred.

To facilitate handling and heating the wax composition, it is preferred to use a convenient heat and water resistant plastic container as the containment means. In this way, the wax composition may be pre-weighed in the correct amount, properly stored and heated in a safe spill-proof manner.

The wax composition should have a melting point temperature range that is hot, yet does not cause harm when contacted with human skin or glove material. Suitable melting temperatures have been found to range between about 39° and 55° C. Melting point temperatures ranging between 42° and 50° C. are preferred.

Suitable wax compositions include hydrocarbon based paraffin wax, or waxes composed of long chain esters, or other fatty materials of the correct melting range. Semi-solid triglyceride fats of the correct melting range could also be used. Although they would be a wax-like material, chemically they would best be described as fats. Additionally, fragrances, antioxidants, herbal extracts, emollients, colors and other similar materials may be added to the composition. Examples of suitable wax compositions are as follows:

| | Composition | | | | |
|---|---|---|---|---|---|
| Material | 1 % by Wt. | 2 % by Wt. | 3 % by Wt. | 4 % by Wt. | 5 % by Wt. |
| Paraffin Wax-melting point 38.9–42.2° C. | 50 | 49.5 | 98 | 20 | 0 |
| Paraffin Wax-melting point 48.9–52.8° C. | 50 | 49.5 | 0 | 78 | 95 |
| Perfume | 0 | 0.5 | 1 | 1 | 0 |
| Vitamin E Acetate | 0 | 0.5 | 1 | 1 | 0 |
| Light Mineral Oil | 0 | 0 | 0 | 0 | 5 |

The containment means enclosing the wax composition may be exposed to an external heating source until a molten wax mixture is produced. The external heating mechanism may include a hot water bath, a microwave, electrical heaters and other equivalent heating mechanisms known in the art. The containment means should be resistant to the external heating source and resulting temperature rise, while remaining intact or sealed when the wax becomes molten and flowable. The containment means may comprise a flexible container, such as a pouch or sleeve constructed of plastic materials such as polypropylene, polyethylene or plastic/metal laminates. Alternatively, the containment means may include the elastic gloves per se, or a component thereof, including a submerged sleeve or compartment located within the glove.

Preferably, the containment means is opened after the wax composition is melted. However, the containment means with the wax composition may be opened prior to melting the wax in a separate container such as a plastic or metal jar, bottle, or can-like structure.

Upon achieving a flowable state, the wax composition is transferred into an elastic glove, as defined above. Thereafter, the user's hand is placed into the glove and the wax is distributed over the hand by repetitively squeezing, pressing or flexing the gloves and hands. When the treatment is being performed on both hands simultaneously, the wax may be evenly dispersed by repetitively pressing one gloved hand against the other.

The molten wax mixture should be allowed to solidify in a continuous layer around one's hand for a predetermined period of time. The effective time period is typically about five to thirty minutes. Once the user determines that the treatment is over, the gloves may be peeled off and discarded along with the wax.

As an alternative, a user may apply a hand cream, lotion or other cosmetic material to the hands prior to their insertion into the gloves containing the molten wax mixture. The occlusion and heat from the molten wax facilitates penetration of the cosmetic material into the skin.

While the invention has been described with respect to a preferred embodiment, it will be apparent to those skilled in the art that various modifications and improvements may be made without departing from the spirit and scope of the invention. Accordingly, it is to be understood that the invention is not to be limited by the specific illustrative embodiments, but only by the scope of the appended claims.

I claim:

1. A process for treating a user's hand with a wax composition and an elastic glove, said wax composition having a melting point temperature less than a temperature that would be harmful to said hand, said elastic glove having an elasticity that allows it to stretch to at least 150% of its original length and return to at least 20% of its original length, wherein the steps comprises:

A. melting said wax composition to a flowable state;

B. depositing the flowable wax composition into said elastic glove;

C. inserting said hand into said elastic glove;

D. distributing the molten mixture over said hand;

E. maintaining said hand within said elastic glove for an effective period of time; and wherein step A is carried out by heating said wax composition to a temperature between about 39° to 55° C. and step D is carried out by squeezing the exterior of said elastic glove.

2. The process of claim 1 wherein said wax composition is initially enclosed within a containment means and step A is carried out by heating said containment means and step B is carried out by transferring the flowable wax composition from said containment means to said elastic glove.

3. The process of claim 1 wherein said effective period of time comprises at least five minutes.

4. The process of claim 1 wherein a second elastic glove is provided for a second hand and said wax composition is supplied in an amount sufficient to coat two hands, said process including repeating steps B through E with said second elastic glove and said second hand.

5. The process of claim 4 wherein step B is performed by repetitively squeezing together said first and second elastic gloves.

6. The process of claim 1, including the step of applying a cosmetic material to said hand prior to step C.

7. A process for treating a user's hand with a wax composition and an elastic glove, said wax composition being enclosed within said elastic glove and having a melting point temperature less than a temperature that would be harmful to said hand, said elastic glove having an elasticity that allows it to stretch to at least 150% of its original length and return to at least 20% of its original length, wherein the steps comprises:

A. heating said elastic glove until said wax composition has melted to a flowable state;

B. inserting said hand into said elastic glove;

C. distributing the flowable wax composition over said hand;

D. maintaining said hand within said elastic glove for an effective period of time; and wherein step A is carried out by heating said wax composition to a temperature between about 39° to 55° C. and step C is carried out by squeezing the exterior of said elastic glove.

8. The process of claim 7 wherein a second elastic glove is provided for a second hand and said wax composition is supplied in an amount sufficient to coat two hands, said process including repeating steps A through D with said second elastic glove and said second hand.

* * * * *